US011548016B2

(12) United States Patent
Kinle et al.

(10) Patent No.: US 11,548,016 B2
(45) Date of Patent: Jan. 10, 2023

(54) SHOWER HEAD HAVING A JET DISC HOLDING DEVICE

(71) Applicant: Hansgrohe SE, Schiltach (DE)

(72) Inventors: Ulrich Kinle, Schenkenzell (DE); Fabian Melle, Durbach (DE)

(73) Assignee: Hansgrohe SE, Schiltach (DE)

( * ) Notice: Subject to any disclaimer, the term of this patent is extended or adjusted under 35 U.S.C. 154(b) by 101 days.

(21) Appl. No.: 16/724,187

(22) Filed: Dec. 20, 2019

(65) Prior Publication Data

US 2020/0206756 A1 Jul. 2, 2020

(30) Foreign Application Priority Data

Jan. 2, 2019 (DE) ..... 10 2019 2000 12.6

(51) Int. Cl.
*B05B 1/18* (2006.01)

(52) U.S. Cl.
CPC ..... *B05B 1/185* (2013.01)

(58) Field of Classification Search
CPC ..... B05B 1/185
USPC ..... 239/548, 549, 600
See application file for complete search history.

(56) References Cited

U.S. PATENT DOCUMENTS 6,799,735 B2 * 10/2004 Watanabe ..... C23C 16/45565 239/596
8,109,451 B2 * 2/2012 Mazzola ..... B05B 1/185 239/600
2008/0295242 A1 12/2008 Tsai
2009/0218420 A1 9/2009 Mazzola
2017/0157627 A1 6/2017 Butzke et al.

FOREIGN PATENT DOCUMENTS

| | | | |
|---|---|---|---|
| CN | 106944270 | A | 7/2017 |
| DE | 3726788 | A1 | 2/1989 |
| DE | 102013224053 | A1 | 5/2015 |
| DE | 102015224107 | A1 | 6/2017 |

OTHER PUBLICATIONS

European Search Report (in German language) issued by the German Patent Office, dated May 7, 2020, for European Patent Application No. 19214120.8; 11 pages.

(Continued)

*Primary Examiner* — Christopher S Kim
(74) *Attorney, Agent, or Firm* — Bose McKinney & Evans LLP

(57) ABSTRACT

A shower head including a base body, a jet disc held on a shower jet discharge side of the base body and including at least one jet discharge opening, and a jet disc holding device for fixing the jet disc on a jet disc holding region of the base body. Illustratively, the jet disk holding device includes a plurality of plug connector pins and associated pin through-passage openings, across which a respective one of the plug connector pins is passed through, wherein the respective pin through-passage opening is provided on the jet disk holding region of the base body or on the jet disk, and wherein the plug connector pins and the pin through-passage openings are configured for latched retaining of the plug connector pins within the pin through-passage openings.

23 Claims, 4 Drawing Sheets

(56) References Cited

OTHER PUBLICATIONS

Office Action in German Language issued by the German Patent Office, Munich, Germany, dated Sep. 16, 2019, for German Patent Application No. 10 2019 200 012.6.
Office Action issued by the National Intellectual Property Administration, P.R. China, dated Nov. 2, 2021 for Chinese Patent Application No. 202010013549.X (Chinese Language), 9 pages.

* cited by examiner

SHOWER HEAD HAVING A JET DISC HOLDING DEVICE

CROSS-REFERENCE TO RELATED APPLICATION

This application claims priority to German Patent Application No. DE 10 2019 2000 12.6, filed on Jan. 2, 2019, the disclosure of which is expressly incorporated herein by reference.

BACKGROUND AND SUMMARY OF THE DISCLOSURE

The disclosure relates to a shower head comprising a base body, a jet disc which is held on a shower jet discharge side of the base body and includes at least one jet discharge opening, and a jet disc holding device by way of which the jet disc is held to a jet disc holding region of the base body.

Shower heads of this type are used in diverse embodiments and are suitable, for example, for sanitary showers such as hand-held showers, side showers, and head showers in shower and bath tub installations.

Shower heads of this type in which the jet disc holding device contains a single screw which from the outside is pushed through a centric opening in the jet disc and is screwed into a centric thread on the base body so as to then by way of the screw head of said screw hold the jet disc on the base body are known. This jet disc holding technique is suitable only to a limited extent for shower heads comprising a jet disc which have a multiplicity of jet discharge openings having comparatively small passage cross sections, for example for shower heads which are embodied for providing a so-called fine jet or needle jet as a type of shower jet, and to this end having corresponding fine jet openings or needle jet openings as jet discharge openings. In the case of shower heads of this type, high internal pressures can arise on account of the infed fluid such as shower water, for example by way of limescale deposition effects, on account of which enhanced requirements pertaining to the holding force to be provided by the jet disc holding device result. Such fine jet shower heads in most instances more often also possess a significantly higher number of jet discharge openings than classic shower heads which are configured for providing a normal shower jet having a classic larger single-jet diameter and correspondingly a larger passage cross section of the jet discharge openings. This increased number of jet discharge openings per unit of area of the jet disc can lead to a decrease in inherent stability or flexural stiffness of the jet disc.

The sole centric jet disc fastening to the shower head base body by means of a single screw often proves to be no longer optimal in such cases. The use of a plurality of fastening screws is also often not a desirable alternative. Screws are relatively expensive, and the tightening torque of said screws has to be precisely adhered to so that the screws sit in a sufficiently tight manner and unintentional releasing is avoided, on the one hand, and the corresponding screw openings do not rupture, on the other hand.

The laid-open publication DE 10 2013 224 053 A1 discloses a shower head of the type mentioned at the outset in which the jet disc holding device has first centric holding means for establishing a centric region of the jet disc on the base body, and second peripheral holding means for establishing a peripheral region of the jet disc on the base body, wherein the first and the second holding means can in each case be in particular a bayonet mount, a screw mount, or a snap-fit mount.

The present disclosure illustratively provides a shower head of the type mentioned at the outset in which the jet disc holding device can be produced with relatively low complexity, enables a relatively simple assembly of the jet disc on the shower head base body, and/or makes available an optimized holding functionality for the jet disc on the shower head base body which is also readily suitable for shower heads of the fine jet type.

The illustrative embodiment of the present disclosure provides a specific shower head comprising a base body, a jet disk held on a shower jet discharge side of the base body and including at least one jet discharge opening, and a jet disk holding device for holding the jet disk on a jet disk holding region of the base body.

According to a first aspect of the present disclosure, the jet disc holding device comprises a plurality of plug connector pins and associated pin through-passage openings through which the respective one of the plug connector pins is passed. The respective pin through-passage opening is provided on the jet disc holding region of the base body or on the jet disc. The plug connector pins and the pin through-passage openings are configured for latched retaining of the plug connector pins in the pin through-passage openings. The jet disc holding device embodied in such a manner can be produced with relatively low complexity, and makes the attaching of the jet disc to the shower head base body rather simple in that the jet disc by means of the jet disc holding device only has to be plug-fitted to the shower head base body or be plug-fitted onto the latter. In particular, no screws and no special tools are required to this end.

By way of this jet disc holding device, the shower head when required can be embodied with a high resistance to pressure, that is to say that even a relatively high internal pressure in the shower head on account of the fluid pressure of the fluid supplied to the shower head does not lead to functionally compromising deformations on the jet disc, or damage to the jet disc. The jet disc holding device specially embodied in this way is capable of resisting even such increased fluid pressure forces and of holding the jet disc on the base body of the shower head in a manner sufficiently stable in terms of deformation even in those cases in which the jet disc per se does not have a very high dimensional stability and/or possesses a relatively large number, or area density, of jet discharge openings, for example more than 100, and in particular more than 150, jet discharge openings at a mutual spacing of at most 1 to 5 mm.

In corresponding embodiments, the plug connector pins and the associated pin through-passage openings in terms of the longitudinal central axis of the jet disc are situated on at least two different radii and/or at least two different circumferential angles. In corresponding embodiments, the plug connector pins and the pin through-passage openings are in this way disposed so as to be distributed across a planar extent of the jet disc. A correspondingly uniform distribution of the holding force provided by the jet disc holding device can thus be achieved across the entire extent of the jet disc.

In a refinement of the present disclosure, at least one of the pin through-passage openings, preferably a plurality of pin through-passage openings, and in advantageous embodiments all pin through-passage openings, has/have a radially elastically resilient opening edge. By way of the latter the respective pin through-passage opening on the opening edge thereof is capable of yielding in a radially elastic manner to the plug connector pin to be plug-fitted into the pin through-passage opening and to again contract in a radially elastic manner so as to firmly hold the plug connector pin once the latter has been pushed through.

In a refinement of the present disclosure, at least one of the plug connector pins, preferably a plurality of plug connector pins, and in one advantageous embodiment all plug connector pins, has/have a mushroom-shaped latching head which is configured for the latching engagement behind by a latching edge of the assigned pin through-passage opening. The respective plug connector pin which in a plug-fitting direction is capable of being plug-fitted axially into the pin through-passage opening can in this way be secured in relation to being axially released from the pin through-passage opening in a manner counter to the plug-fitting direction. Moreover, the mushroom shape of the latching head can facilitate the pushing-through of the plug connector pin by way of the latching head thereof through the pin through-passage opening in that the mushroom head by way of the oblique, or conical, respectively, shell face thereof forms a run-on face that presses against the latching edge of the pin through-passage opening. This is particularly advantageous when the latching edge in corresponding embodiments is formed as a radially elastically resilient opening edge of the pin through-passage opening. In this case, the mushroom-shaped latching head when pushing through the plug connector pin can expand the latching edge in a radially elastic manner, and the latching edge can contract again in the radially elastic manner and engage in a latching manner behind the latching head once the latching head has passed through.

In an illustrative embodiment of the present disclosure, at least one of the pin through-passage openings, preferably a plurality of pin through-passage openings, and in advantageous embodiments all pin through-passage openings, is/are formed by a holding dome-shaped section of the jet disc holding region or of the jet disc. The holding dome-shaped section has a dome bottom region and a dome head region. The plug connector pin by way of its latching head leading is insertable axially into the holding-dome-shaped section from the dome bottom region. The dome head region contains a through-passage hole, the hole edge thereof forming the latching edge of the pin through-passage opening. This dome-shaped design of the section of the jet disc holding region or of the jet disc that forms the respective pin through-passage opening facilitates the provision of a high holding force by virtue of the advantageous force dissipation characteristic, in particular in terms of acting compression forces, which is known per se in such dome shapes. Such compression forces can act on the holding dome-shaped section when the pushed-through plug connector pin is stressed in terms of tension on account of the fluid pressure in the shower head.

In an illustrative embodiment of the present disclosure, an outer diameter of the holding dome-shaped section in the dome bottom region is larger than in the dome head region. This corresponds to the usual dome shape and facilitates the achievement of a high resistance force of the jet disc holding device in relation to the acting fluid pressure.

In an illustrative embodiment of the present disclosure, the holding dome-shaped portion is configured so as to be slotted by one or a plurality of axial slots. This can promote the radially elastic resilience of the opening edge or the latching edge of the respective pin through-passage opening. The respective axial slot can be embodied according to the requirement so as to be axially continuous from a dome bottom region up to a dome head region, or so as to be closed axially on one side or both sides.

In an illustrative embodiment of the present disclosure, the at least one plug connector pin, which on an axial end region thereof has the mushroom-shaped latching head, on the other axial end region thereof that faces away from the latching head comprises a radially projecting holding shoulder. The plug connector pin by way of said holding shoulder can interact in a holding manner with the jet disc or the jet disc holding region, while said plug connector pin by way of the mushroom-shaped latching head thereof interacts with the assigned pin through-passage opening which is situated on the respective other of the two components, i.e. the jet disc holding region and the jet disc.

According to a second aspect of the present disclosure, which is provided alternatively or additionally to the first aspect, the jet disc comprises a plurality of the jet discharge openings which for the synchronous supply of fluid are in fluid communication with a common assigned fluid supply chamber. The jet disc at least in a region between two of said jet discharge openings abuts in a fluid-tight manner against the jet disc holding region of the base body, and the base body comprises a plurality of fluid feed ducts leading out of the common fluid supply chamber, of which a first fluid feed duct leads to one of the two respective jet discharge openings, and a second fluid feed duct, separate from the first fluid feed duct, leads to the second of the two respective jet discharge openings. In other words, said two jet discharge openings in each of optionally a plurality of shower jet types of the shower head are at all times supplied collectively with fluid from the same fluid supply chamber, wherein said common fluid supply chamber is not situated in the boundary region between the jet disc and the opposite jet disc holding region of the base body, but is situated at a spacing from said boundary region so as to be upstream of the latter, for example on a side of the jet disc holding region of the base body that faces away from the jet disc. The two jet discharge openings by way of the fluid feed ducts that are provided in the base body are coupled to said spaced-apart fluid supply chamber.

In the case of shower head embodiments which are conceived for a plurality of jet types in which the jet discharge openings are grouped so as to form groups which are fed or not fed with fluid in a dissimilar manner depending on the shower jet type, the shower head in a manner known per se correspondingly comprises a plurality of fluid supply chambers which are capable of being fluidically impinged in parallel, for example a first fluid supply chamber for a centric group of the jet discharge openings, a second fluid supply chamber for a circumferential group of the jet discharge openings, and a third fluid supply chamber for a group of the jet discharge openings that lie therebetween. The characterization of the abutting of the jet disc in a fluid tight manner against the jet disc holding region of the base body mentioned above, in this case applies in particular to at least one region between two jet discharge openings which are both assigned to one of said plurality of fluid supply chambers.

By way of this implementation of the present disclosure, it is consequently possible for at least two jet discharge openings, which are preferably directly adjacent jet discharge openings, that are synchronously supplied with fluid to be fluidically separated at the level of the boundary region between the jet disc and the jet disc holding region of the base body, that is to say so as to keep said two jet discharge openings fluidically separated from one another. It is to be understood that more than two jet discharge openings or a plurality of groups of in each case one or a plurality of jet discharge openings can in this way at all times be fluidically supplied in a synchronous manner independently of the shower jet type, on the one hand, and be sealed in relation to the other at the level of the boundary region between the jet disc and the jet disc holding region of the base body, on the other hand.

This embodiment avoids the presence of a fluid supply chamber or cavity in the region between the jet disc and the jet disc holding region such that it is thus avoided that a high fluid pressure can build up in said region.

Consequently, the fluid pressure stress on the jet disc can be kept low by way of this measure even when a high fluid pressure should form in the shower head. Said high fluid pressure is restricted to a region of the shower head that is remote from the jet disc, for example to the region of said common fluid supply chamber which is situated, for example, between a fluid entry region of the shower head and the jet disc holding region of the base body. The shower head base body which is typically embodied so as to be rigid or bending-resistant shields the jet disc in relation to high fluid pressures of this type.

In an advantageous embodiment the jet disc, as in the example shown, in a circumferentially closed fluid-tight manner abuts against the jet disc holding region of the base body about each jet discharge opening, or about groups of in each case one or a plurality of the jet discharge openings, and the base body for each jet discharge opening or each group of jet discharge openings comprises a dedicated fluid feed duct that leads out of the associated fluid supply chamber. In this case, the jet discharge openings at the level of the boundary region of the jet disc and the base body are consequently completely sealed in relation to one another either individually or in groups, such that no cavity is present there and accordingly no fluid positive pressure can build up there.

In a refinement of the illustrative embodiment, the respective plug connector pin is configured integrally with the jet disc. This can be advantageous in terms of production technology and assembly technology. The plug connector pin in this case can be plugged into the associated pin through-passage opening by plug-fitting the jet disc to the jet disc holding region.

In an alternative refinement of the illustrative embodiment, the respective plug connector pin is configured integrally with the jet disc holding region. In this case, the jet disc has the associated pin through-passage opening into which the plug connector pin that projects from the jet disc holding region makes its way when plug-fitting the jet disc to the jet disc holding region.

In a further alternative refinement of the illustrative embodiment, the respective plug connector pin is configured as a component that is separate from the jet disc and the jet disc holding region. In the case of this embodiment, the plug connector pin in material technological terms can be decoupled from the jet disc and the jet disc holding region when required, that is to say can be composed of a material other than that of the jet disc and/or the jet disc holding region.

In a refinement of the illustrative embodiment, the plug connector pins and the assigned pin through-passage openings in relation to a longitudinal central axis of the jet disc are situated on at least two different radii and/or at at least two different circumferential angles. On account thereof, the jet disc can be established at correspondingly different fastening points on the jet disc holding region. In advantageous embodiments said fastening points are disposed so as to be distributed in a substantially uniform manner across the planar extent of the jet disc. Alternatively, embodiments are possible in which the fastening points defined by the plug connector pins in a jet disc region having a comparatively high pressure load are disposed more densely, that is to say having smaller mutual spacings, than in a region with a comparatively low pressure load.

In corresponding refinements of the present disclosure, the jet disc holding region and/or the jet disc and/or the plug connector pins are/is made from a plastic material. This choice of material can be made in a suitable manner depending on the requirement and the specific application. For example, all three components can thus be formed from an identical plastic material or from different plastic materials, or the jet disc and the jet disc holding region are formed from a plastic material while the plug connector pins are formed from a metallic material.

In a refinement of the present disclosure, the jet disc has a bending-resistant perforated jet disc plate, and a bending-flexible jet mat on a rear side of the disc plate that faces the jet disc holding region, wherein discharge nipples which form the jet discharge openings and extend through nipple through-passage openings in the disc plate are configured on the jet mat.

In a variant, the plug connector pins interact in a retaining manner with the disc plate. The retaining interaction of the plug connector pins and the disc plate can be implemented, for example, in that the disc plate comprises the pin through-passage openings with which the plug connector pins by way of the latching head thereof interact, or in that the plug connector pins by way of the radially projecting holding shoulder thereof interact with the disc plate. In advantageous embodiments, the bending-flexible jet mat moreover functions as a seal between the jet discharge openings in the region between the jet disc and the jet disc holding region of the base body.

In an additional or alternative variant, the jet disc by way of the jet mat thereof abuts in a planar fluid-tight manner against the jet disc holding region of the base body and delimits the jet discharge openings individually in a mutually fluid-tight manner. The jet mat thus also functions as a sealing means by way of which the entry-side regions of the jet discharge openings in the boundary region between the jet disc and the jet disc holding region are held so as to be individually fluidically separated from one another, on account of which the build-up of an undesirable fluid positive pressure can be reliably avoided in this boundary region.

Additional features and advantages of the present invention will become apparent to those skilled in the art upon consideration of the following detailed description of the illustrative embodiments best exemplifying the best mode of carrying out the invention as presently perceived.

BRIEF DESCRIPTION OF THE DRAWINGS

Advantageous embodiments of the invention are illustrated in the drawings. These and further embodiments of the invention are described in greater detail below. In the drawings.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
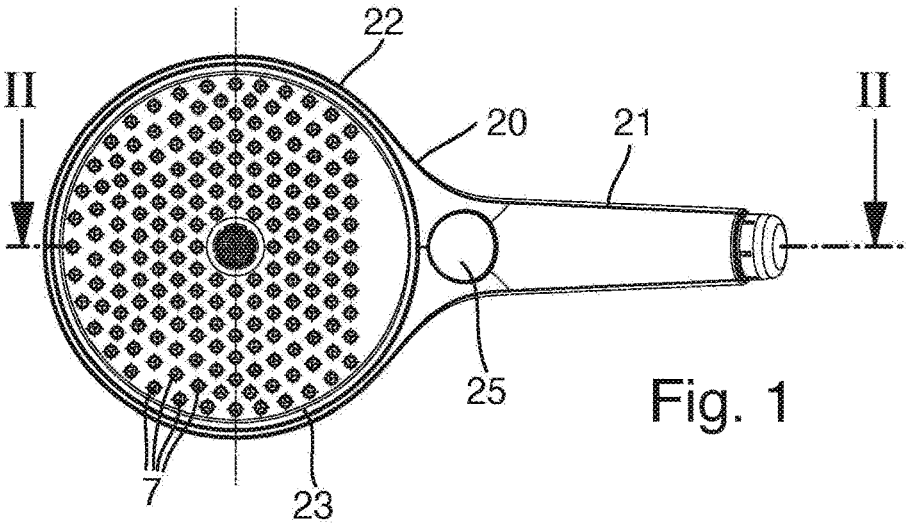
FIG. 1 shows a plan view from below of a sanitary hand-held shower having a shower head.
Figure 2:
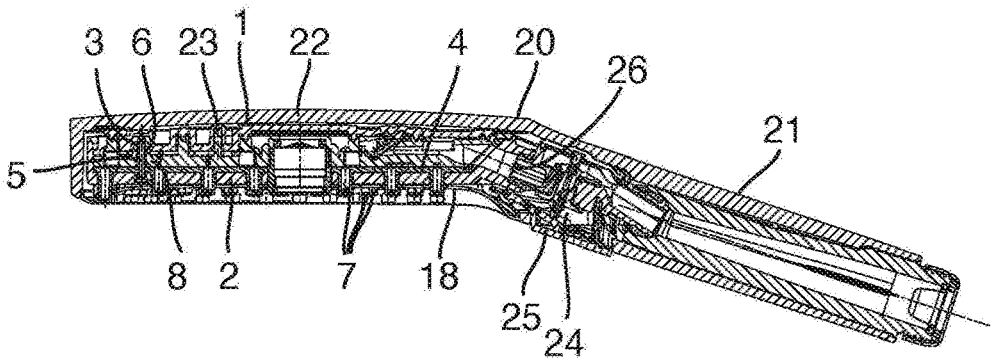
FIG. 2 shows a sectional view along a line II-II in FIG. 1.
Figure 3:
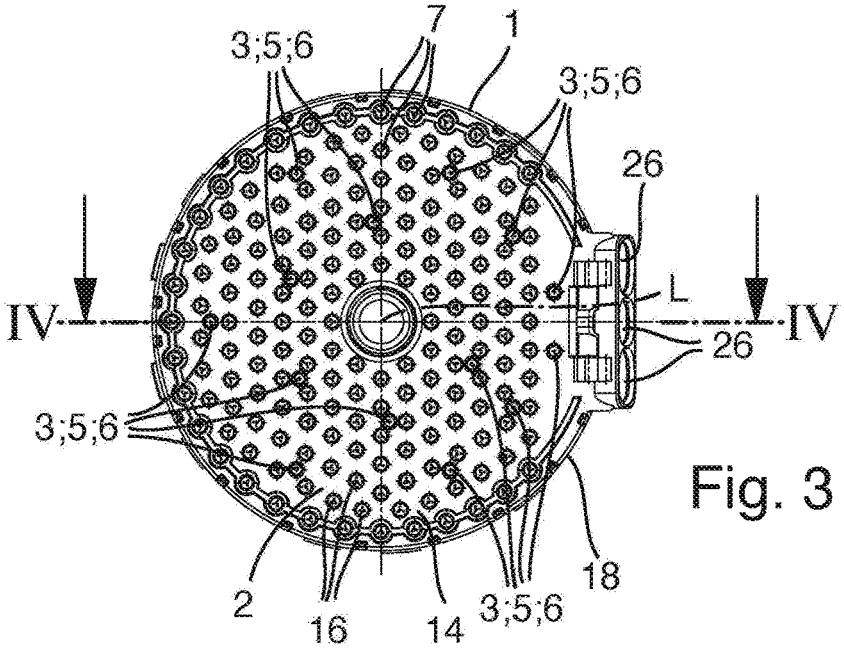
FIG. 3 shows a plan view from below, that is to say counter to a shower jet discharge direction, of part of a shower head having a base body and a jet disc, said shower head being capable of being used in the hand-held shower of FIGS. 1 and 2, for example.
Figure 4:
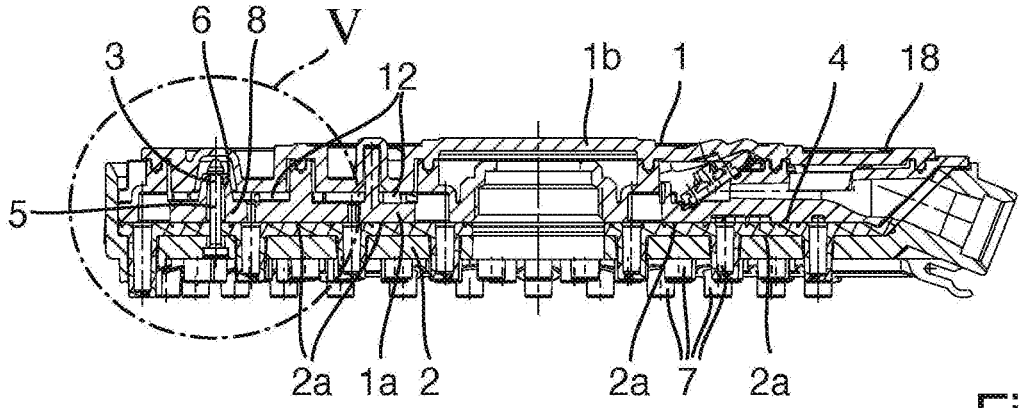
FIG. 4 shows a sectional view along the line IV-IV in FIG. 3.
Figure 5:
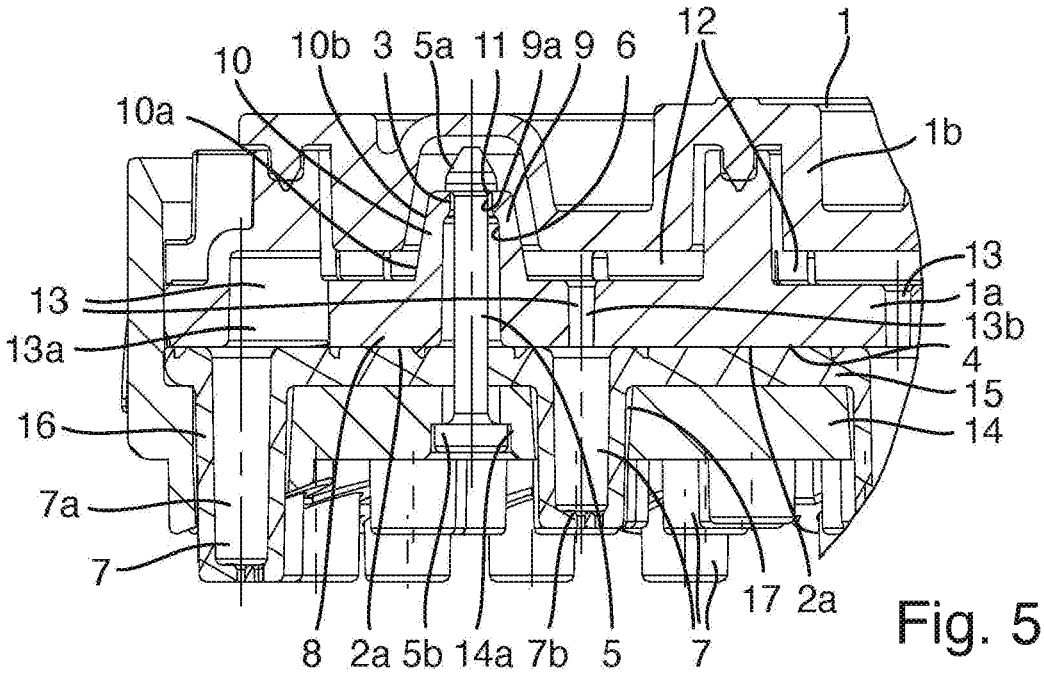
FIG. 5 shows a view of a detail of a region V in FIG. 4.
Figure 6:
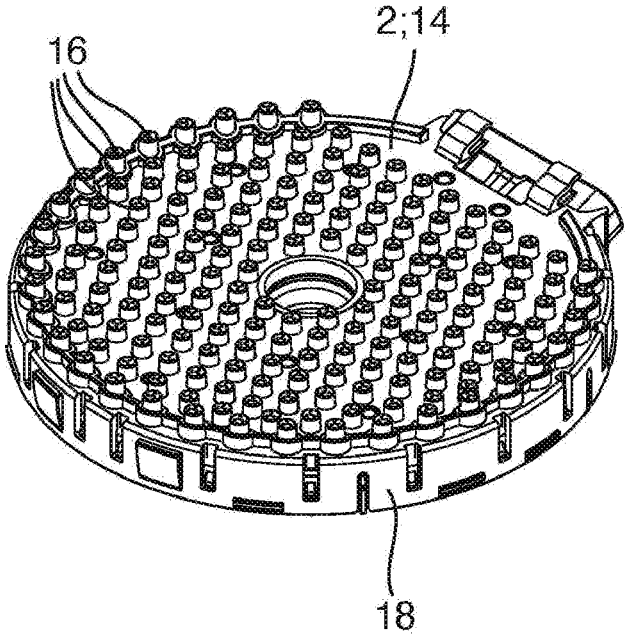
FIG. 6 shows a perspective view from below of the shower head part of FIGS. 3 to 5.

The sanitary hand-held shower shown in FIGS. 1 and 2 comprises a hand-held shower housing 20 of a shape usual per se, having a hollow grip part 21 and a housing head part 22. The supply of a shower fluid is performed in the usual manner by way of the hollow grip part 21, for example by connecting to a shower hose. The housing head part 22, conjointly with further shower head components accommodated therein, forms a shower head 23. The hand-held shower in the embodiment shown is configured in a manner known per se for providing a plurality of jet types, to which end the shower head 23 is correspondingly conceived having multiple ducts, that is to say possesses a plurality of fluidically parallel fluid feeds 26, a distributor valve 24 which is activatable by the user by way of an operating element, in this case by way of a pushbutton 25, for example, being disposed upstream of said fluid feeds 26.

FIGS. 3 to 9 visualize the presently interesting component parts of a shower head such as can be used in the hand-held shower of FIGS. 1 and 2, alternatively for any other shower, for example for sanitary side showers and head showers as well as for non-sanitary showers by way of which water or another fluid can be provided as a shower jet.

The shower head visualized in FIGS. 3 to 9, and visualized in the use in the hand-held shower of FIGS. 1 and 2, includes a base body 1, a jet disc 2, and a jet disc holding device 3. The jet disc 2 is held on a shower jet discharge side 4 of the base body 1 and has at least one jet discharge opening 7. In the example shown, a plurality of jet discharge openings 7 are provided, wherein the number of jet discharge openings 7 depends on the specific application. For example, only a single jet discharge opening 7 is in most instances present for providing a cascade jet, while often more than 100 or else more than 150 jet discharge openings, typically at a mutual spacing of at most 1 mm to 5 mm are present for large-area jet discs 2 and/or for shower heads of the fine jet/needle jet type. The jet disc holding device 3 serves for holding the jet disc 2 on a jet disc holding region 8 of the base body 1.

The jet disc holding device 3 comprises a plurality of plug connector pins 5 and a corresponding plurality of assigned pin through-passage openings 6 through which one of the plug connector pins 5 is in each case push-fitted. The respective pin through-passage opening 6 in the case of the embodiment of the shower head shown in FIGS. 3 to 9 is configured on the jet disc holding region 8 of the base body 1. In alternative embodiments, the respective pin through-passage opening 6 is configured on the jet disc 2. The plug connector pins 5 and the pin through-passage openings 6 are configured for firmly holding the pin connector pins 5 in a latching manner in the pin through-passage openings 6.

In corresponding embodiments of the shower head, at least one of the pin through-passage openings 6 has a radially elastically resilient opening edge 9. In the example shown, all pin through-passage openings 6 have the radially elastically resilient opening edge 9. In alternative embodiments, none of the pin through-passage openings 6, or only part of the pin through-passage openings 6, have the radially elastically resilient opening edge 9, and instead have a non-radially elastically resilient opening edge with which an elastically resilient region of the respective plug connector pin 5 can in this instance interact, for example.

In corresponding embodiments, at least one of the connector pins 5, as in the example shown, has a mushroom-shaped latching head 5*a* which is configured for the latching engagement behind by a latching edge 9*a* of the assigned pin through-passage opening 9. In the example shown, all plug fastening pins 5 have the mushroom-shaped latching head 5*a*; in alternative embodiments none of the plug fastening pins 5, or only part of the plug fastening pins 5, have the mushroom-shaped latching head 5*a*. In this case, the respective plug fastening pin is firmly held in a latching manner in the associated pin through-passage opening by means of another latching connection known per se.

In advantageous embodiments as in the exemplary embodiment shown, at least one of the pin through-passage openings 6 is formed by a holding dome-shaped section 10 of the jet disc holding region 8 or of the jet disc 2, wherein the holding dome-shaped section 10 has a dome bottom region 10*a* from where the assigned plug connector pin 5 by way of its latching head 5*a* leading is insertable axially into the holding dome-shaped section 10, and a dome head region 10*b* which includes a through-passage hole 11, the hole edge thereof forming the latching edge 9*a* of the pin through-passage opening 9. In the example shown, each pin through-passage opening 6 is in each case formed by one such holding dome-shaped section 10 of the jet disc holding region 8 of the base body 1; in alternative embodiments none of the pin through-passage openings 6, or only part of the pin through-passage openings 6, are formed by such a holding dome-shaped section and instead, for example, by a simple hole in a plate-shaped section of the jet disc holding region, or at least one of the pin through-passage openings 6 is formed by a holding dome-shaped section 10 of the jet disc 2 instead of the jet disc holding region 8.

In corresponding embodiments an outer diameter of the holding dome-shaped section 10 on the dome bottom region 10*a* is larger than on the dome head region 10*b*, as in the exemplary embodiment shown; in alternative embodiments said diameters can also be of identical size, for example. In corresponding embodiments the respective holding dome-shaped section 10 is configured so as to be slotted by one or a plurality of axial slots in a manner so as to be actually closed on one side or both sides, or so as to be continuously slotted, or alternatively so as to be completely closed on the shell side.

In corresponding embodiments the at least one plug connector pin 5, as in the example shown, on the end region thereof that faces away from the mushroom-shaped latching head 5*a* has a radially projecting holding shoulder 5*b*. In the example shown, all plug connector pins 5 have said holding shoulder 5*b*; in alternative embodiments, none of the plug connector pins 5, or only part of the plug connector pins 5, have said holding shoulder 5*b*.

The respective plug connector pin 5 instead of the holding portion 5*b* can have another conventional holding means, for example latching cams or a force-fitting holding means, by way of which said plug connector pin 5 in a holding manner interacts with the jet disc 2, or in alternative embodiments with the jet disc holding region 8 of the base body 1, respectively.

In corresponding embodiments the jet disc 2, as in the example shown, has a plurality of the jet discharge openings 7 which are collectively in a fluidic connection with an assigned fluid supply chamber 12, wherein the jet disc 2 at least in a region 2*a* between two 7*a*, 7*b* of said jet discharge openings 7 abuts in a fluid-tight manner against the jet disc holding region 8 of the base body 1, and the base body 1 has a plurality of fluid feed ducts 13 leading out of the common fluid supply chamber 12, of which a first fluid feed duct 13*a* leads to one 7*a* of the two respective jet discharge openings 7*a*, 7*b*, and a second fluid feed duct 13*b*, separate from the first fluid feed duct 13*a*, leads to the other 7*b* of the two respective jet discharge openings 7*a*, 7*b*.

In an advantageous embodiment the jet disc 2 in a circumferentially closed fluid-tight manner abuts against the jet disc holding region 8 of the base body 1 about each jet discharge opening 7, and the base body 1 for each jet discharge opening 7 has a dedicated fluid feed duct 13 leading out of the associated fluid supply chamber 12. In this case, the jet discharge openings 7 at the level of the boundary region of the jet disc 2 and the base body 1 are consequently completely sealed in relation to one another such that no cavity is present there and accordingly no fluid positive pressure can build up there. Such a fluid positive pressure can if at all build up in the upstream fluid supply chamber 12 where said fluid positive pressure can be readily absorbed by the base body 1 on account of the comparatively stable construction of the latter.

In alternative embodiments the jet disc 2 abuts against the jet disc holding region 8 of the base body 1 in such a manner that not each jet discharge opening 7 is separated individually in a fluid-tight manner in relation to the other jet discharge openings 7, but the jet discharge openings 7 are fluidically separated in groups. In this case, the jet discharge openings 7 are subdivided into groups, wherein at least one group comprises two or more jet discharge openings 7, and said jet discharge openings 7 of the same group at the level of the boundary region between the jet disc 2 and the base body 1 are not fluidically separated among one another but are fluidically separated from all other jet discharge openings 7. In the case of at least two such groups of the jet discharge openings 7 herein these are groups of which the jet discharge openings 7 are associated with an identical shower jet type of the shower head, that is to say that all shower jet types are supplied, or not supplied, respectively, in synch with the shower fluid from an identical one of in this case typically a plurality of fluid supply chambers 12.

In corresponding embodiments the respective plug connector pin 5, as in the example shown, is configured as a component that is separate from the jet disc 2 and the jet disc holding region 8 of the base body 1. In alternative embodiments the respective plug connector pin 5 is configured integrally with the jet disc 2 or integrally with the jet disc holding region 8 of the base body 1.

In corresponding embodiments the plug connector pins 5 and the assigned pin through-passage openings 6 in relation to a longitudinal central axis L of the jet disc are situated on at least two different radii and/or at at least two different circumferential angles. In other words, the plug connector pins 5 and the associated pin through-passage openings 6 in this case are situated at fastening points which have dissimilar spacings from the jet disc longitudinal central axis L and/or are mutually offset in the rotation direction about the jet disc longitudinal central axis L. Said fastening points are preferably disposed so as to be distributed in a substantially uniform manner across the planar extent of the jet disc 2. This typically facilitates a uniform absorption of the fluid pressure forces by the jet disc holding device 3. In alternative embodiments, all of the fastening points are disposed on a common radius in terms of the jet disc longitudinal central axis L, or all of the fastening points are disposed at the same circumferential angle.

In advantageous embodiments the jet disc holding region 8 of the base body 1, the jet disc 2, and the plug connector pins 5 all are formed from a common plastic material or alternatively from different plastic materials. In further alternative embodiments the plug connector pins 5 are formed from a metallic material. In even further alternative embodiments the jet disc 2 and/or the jet disc holding region 8 are/is formed from a metallic material.

Figure 7:
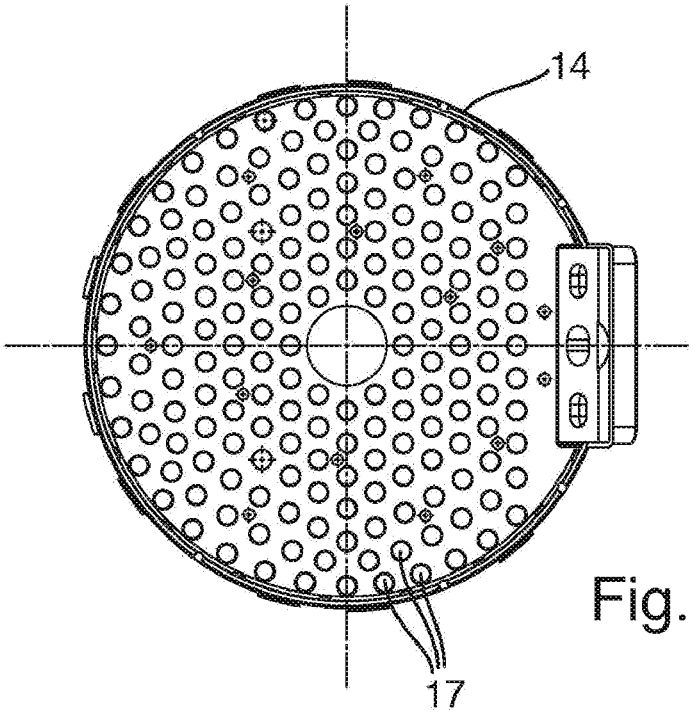
FIG. 7 shows a plan view from above of a jet disc plate of the jet disc of the shower head part of FIGS. 3 to 6.
Figure 8:
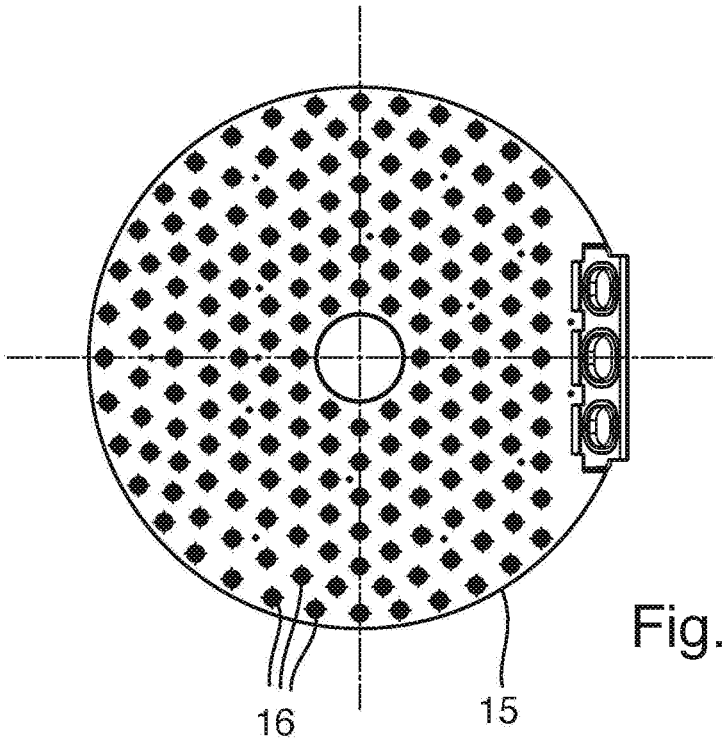
FIG. 8 shows a plan view from above of a jet mat of the jet disc for the shower head according to FIGS. 3 to 6.
Figure 9:
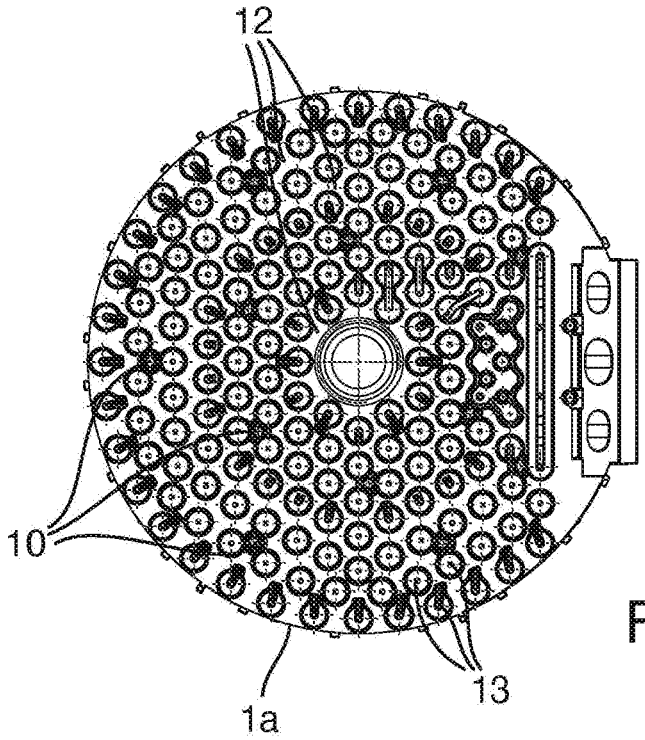
FIG. 9 shows a plan view from above of a base body of a shower head base body of FIGS. 3 to 6.

In an advantageous embodiment the jet disc 2, as in the example shown, comprises a bending-resistant perforated disc plate 14 and a bending-flexible jet mat 15, wherein the jet mat 15 is disposed on a rear side of the disc plate 14 that faces the jet disc holding region 8 of the base body 1. FIG. 7 shows the disc plate 14 in a plan view from above, that is to say in a plan view onto the rear side that in the shower fluid flow direction is upstream. Discharge nipples 16 which form the jet discharge openings 7 and extend through nipple discharge openings 17 in the disc plate 14 are configured on the front side on the jet mat 15. FIG. 8 likewise shows the jet mat 15 in a plan view from above. Said jet mat 15 in this positioning can be placed onto the disc plate 14 of FIG. 7, wherein the discharge nipples 16 of said jet mat 15 are push-fitted through the nipple discharge openings 17 in the disc plate 14.

The plug connector pins 5 preferably interact in a holding manner with the disc plate 14. In the example shown this is implemented in that the disc plate 14 has pin receptacle depressions 14*a* on which the plug connector pins 5 by way of the holding shoulder 5*b* thereof are brought to abut. In alternative embodiments, the plug connector pins 5 interact in a holding manner with the disc plate 14 in another way, for example in that said plug connector pins 5 are configured integrally with the disc plate 14, or are held by being press-fitted into the disc plate 14, or by way of the mushroom-shaped latching head 5*a* of said plug connector pins 5 interact with the holding dome-shaped sections 10, wherein the latter in this instance are configured on the disc plate 14.

The jet mat 15 is preferably composed of an elastomer material and is provided with pin passage-through holes 19 through which the plug connector pins 5 are guided. The jet mat 15 preferably functions as a sealing means by way of which the fluid-tight bearing of the jet disc 2 on the jet disc holding region 8 of the base body 1 can be affected in the region or regions 2*a* between the jet discharge openings 7 or discharge nipples 16.

In advantageous embodiments the base body 1 and the jet disc 2, as in the exemplary embodiment shown, form a cartridge body 18 as an independent component, as is illustrated in FIGS. 3 to 6. The cartridge body 18 forms in particular a component that can be pre-assembled separately from an external housing of the shower head or from the housing head part 22 and can then be inserted into the shower head external housing.

The base body 1 in the exemplary embodiment shown includes two plate-shaped components which are connected to one another while forming the fluid supply chambers 12 lying therebetween, said plate-shaped components specifically being a jet disc holding plate 1*a* providing on the lower side the jet disc holding region 8, and a cover plate 1*b*. The jet disc holding plate 1*a* at the same time functions as a distributor plate for distributing the infed shower fluid into the optionally a plurality of fluidically parallel fluid feeds 26, or individual chambers, that is to say into the plurality of fluid supply chambers 12, and from there into the fluid feed ducts 13 leading to the jet discharge openings 7. To this end, the jet disc holding plate 1*a* or the distributor plate on the upstream side thereof that faces the jet disc holding side comprises a suitable distributor structure profile, as can be seen from FIG. 9 which shows a plan view onto this side of the jet disc holding plate 1*a* or the distributor plate.

As becomes evident from the description above, the invention makes available an advantageous shower head which can be constructed with relatively little complexity so as to be compact and highly resistant to a fluid pressure. Even when a fluid positive pressure in the shower head is created on account of limescale deposition effects, for example, this does not lead to the shower head parts being compromised or damaged. The jet disc having the jet discharge openings thereof can remain unstressed by such fluid positive pressures. The shower head according to the invention can readily withstand fluid positive pressures of up to 5 bar or else up to 10 bar, for example. The jet disc fastening by means of the plug connector pins in comparison to the use of screw fastenings is less complex, less prone to damage, significantly more space-saving, and more reliable in terms of any unintentional release of the fastening. The shower head according to the invention can be implemented using relatively few components, and when using the cartridge construction mode mentioned, it is possible for the cartridge body to be produced exclusively from plastics material, if required. No screw-fitting procedures are required for assembling the shower head and the cartridge body, for example. The plug connector pins can be conceived such that said plug connector pins are stressed only in terms of tension, whereas the surrounding components such as, for example, the holding dome-shaped sections, are stressed in terms of compression. The compressive stress on the holding dome-shaped sections can additionally be a safeguard in relation to the plug connector pins unintentionally sliding out of the pin through-passage openings thereof.

As has already been mentioned, the shower head according to the invention can be used in diverse ways for sanitary and non-sanitary showers.

Although the invention has been described in detailed with reference to preferred embodiments, variations and modifications exist within the spirit and scope of the invention as described and defined in the following claims.

The invention claimed is:

1. A shower head comprising:

a base body, a jet disk held on a shower jet discharge side of the base body and including at least one jet discharge opening, and a jet disk holding device for holding the jet disk on a jet disk holding region of the base body, wherein the jet disk holding device comprises a plurality of plug connector pins and associated pin through-passage openings, through which a respective one of the plug connector pins is passed, wherein the respective pin through-passage opening is provided on the jet disk holding region of the base body or on the jet disk, and wherein the plug connector pins and the pin through-passage openings are configured for latched retaining of the plug connector pins in the pin through-passage openings, wherein at least one of the plug connector pins comprises a mushroom-shaped latching head which is positioned behind a latching edge of the associated pin through-passage opening thus establishing latching engagement, and wherein at least one of the pin through-passage openings is provided by a holding dome-shaped section of the jet disk holding region or the jet disk, wherein the holding dome-shaped section comprises a dome bottom region, from where the associated plug connector pin, with its latching head in front, is insertable axially into the holding dome-shaped section, and a dome head region which includes a through-passage hole, with the hole edge thereof providing the latching edge of the pin through-passage opening.

2. The shower head according to claim 1, wherein at least one of the pin through-passage openings comprises a radially elastically resilient opening edge.

3. The shower head according to claim 1, wherein an outer diameter of the holding dome-shaped section is greater in the dome bottom region than in the dome head region.

4. The shower head according to claim 1, wherein the holding dome-shaped section has a slotted design formed by one or more axial slots.

5. The shower head according to claim 1, wherein the at least one plug connector pin, with the mushroom-shaped latching head on an end region facing away from the latching head, comprises a radially projecting holding shoulder.

6. The shower head according to claim 1, wherein the respective plug connector pin is formed integrally with the jet disk or integrally with the jet disk holding region.

7. The shower head according to claim 1, wherein the plug connector pins and the associated pin through-passage openings are located in relation to a central longitudinal axis of the jet disk on at least two different radii and/or on at least two different circumferential angles.

8. The shower head according to claim 1, wherein the jet disk holding region and/or the jet disk and/or the plug connector pins are/is made of a plastic material.

9. The shower head according to claim 1, wherein:

the jet disk comprises a plurality of the at least one jet discharge opening which are in fluid communication with a common fluid supply chamber for synchronized fluid supply, and the jet disk, at least in a region between two of said jet discharge openings, abuts in a fluid-tight manner against the jet disk holding region of the base body, and the base body comprises a plurality of fluid feed ducts leading out of the common fluid supply chamber, among said fluid feed ducts a first one leads to one of the two said jet discharge openings and a second one, separate from the first one, leads to a second one of the two said jet discharge openings.

10. The shower head according to claim 1, wherein the jet disk includes a bending resistant, perforated jet disk plate and a bending flexible jet mat on a rear side of the disk plate facing towards the jet disk holding region, discharge nipples are provided on the jet mat, which form the jet discharge openings and extend across nipple through-passage openings in the disk plate, and the plug connector pins interact with the disk plate retentively and/or the jet disk with its jet mat abuts flatly in a fluid-tight manner against the jet disk holding region of the base body and delimit the jet discharge openings individually against all other jet discharge openings in a fluid-tight manner.

11. The shower head according to claim 1, wherein the respective plug connector pin is formed as a component separate from the jet disk and the jet disk holding region.

12. A shower head comprising:

a base body, a jet disk held on a shower jet discharge side of the base body and including a plurality of jet discharge openings, and a jet disk holding device for holding the jet disk on a jet disk holding region of the base body, wherein the jet disk holding device comprises a plurality of plug connector pins and associated pin through-passage openings, through which a respective one of the plug connector pins is passed, wherein the respective pin through-passage opening is provided on the jet disk holding region of the base body or on the jet disk, and wherein the plug connector pins and the pin through-passage openings are configured for latched retaining of the plug connector pins in the pin through-passage openings, wherein the jet disk includes a bending resistant, perforated jet disk plate and a bending flexible jet mat on a rear side of the disk plate facing towards the jet disk holding region, wherein discharge nipples are provided on the jet mat, which form the plurality of jet discharge openings and extend across nipple through-passage openings in the disk plate, and wherein:

a) the plug connector pins interact with the disk plate retentively; and/or b) the jet disk with its jet mat abuts flatly in a fluid-tight manner against the jet disk holding region of the base body with the jet mat delimiting each of the plurality of jet discharge openings individually with respect to each other jet discharge opening in a fluid-tight manner.

13. The shower head according to claim 12, wherein at least one of the pin through-passage openings comprises a radially elastically resilient opening edge.

14. The shower head according to claim 12, wherein at least one of the plug connector pins comprises a mushroom-shaped latching head which is positioned behind a latching edge of the associated pin through-passage opening thus establishing latching engagement.

15. The shower head according to claim 14, wherein at least one of the pin through-passage openings is provided by a holding dome-shaped section of the jet disk holding region or the jet disk, wherein the holding dome-shaped section comprises a dome button region, from where the associated plug connector pin, with its latching head in front, is insertable axially into the holding dome-shaped section, and a dome head region which includes a through-passage hole, with the hold edge thereof providing the latching edge of the pin through-passage opening.

16. The shower head according to claim 15, wherein an outer diameter of the holding dome-shaped section is greater in the dome bottom region than in the dome head region.

17. The shower head according to claim 14, wherein the holding dome-shaped section has a slotted design formed by one or more axial slots.

18. The shower head according to claim 14, wherein the at least one plug connector pin, with the mushroom-shaped latching head on an end region facing away from the latching head, comprises a radially projecting holding shoulder.

19. The shower head according to claim 12, wherein the respective plug connector pin is formed integrally with the jet disk or the jet disk holding region.

20. The shower head according to claim 12, wherein the plug connector pins and the associated pin through-passage openings are located in relation to a central longitudinal axis of the jet disk on at least two different radii and/or on at least two different circumferential angles.

21. The shower head according to claim 12, wherein the jet disk holding region and/or the jet disk and/or the plug connector pins are/is made of a plastic material.

22. The shower head according to claim 12, wherein:

the plurality of jet discharge openings are in fluid communication with a common fluid supply chamber for synchronized fluid supply, and the jet disk, at least in a region between two of said jet discharge openings, abuts in a fluid-tight manner against the jet disk holding region of the base body, and the base body comprises a plurality of fluid feed ducts leading out of the common fluid supply chamber, among said fluid feed ducts a first one leads to one of two corresponding jet discharge openings and a second one, separate from the first one, leads to the second one of the two corresponding jet discharge openings.

23. The shower head according to claim 12, wherein the respective plug connector pin is formed as a component separate from the jet disk and the jet disk holding region.

* * * * *